United States Patent [19]

Weinerman et al.

[11] Patent Number: 4,850,208

[45] Date of Patent: Jul. 25, 1989

[54] LATCH AND LOCK ASSEMBLIES WITH SPRING-BIASED PIVOT BOLTS

[75] Inventors: Lee S. Weinerman, Medina; Steven A. Mayo, Akron, both of Ohio; Thomas V. McLinden, Oxford; Timothy H. Wentzell, South Windsor, both of Conn.

[73] Assignee: The Eastern Company, Cleveland, Ohio

[21] Appl. No.: 72,174

[22] Filed: Jul. 10, 1987

Related U.S. Application Data

[63] Continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[4] ..... E05B 13/10

[52] U.S. Cl. ..... 70/208; 70/210; 70/84; 292/227; 292/228; 292/240; 292/DIG. 31

[58] Field of Search ..... 70/81, 83, 84, 208, 70/210, 431, 451, 466, 483–485, 489; 292/198, DIG. 31, 37, DIG. 63, 224, 210, 240–242, 227, 228; 411/522

[56] References Cited

U.S. PATENT DOCUMENTS

| | | | |
|---|---|---|---|
| Re. 14,741 | 10/1919 | Anderson | 292/198 |
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 1,995,106 | 3/1935 | Roedding | 292/227 X |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 3/1955 | Tatom | 292/DIG. 31 X |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,773,376 | 12/1956 | Wartian | 292/210 X |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,872,241 | 2/1959 | Shelden | 292/198 X |
| 2,900,204 | 8/1959 | Pelcin | 292/173 |
| 2,916,905 | 12/1959 | Podlesak | 70/150 |
| 2,924,478 | 2/1960 | Wartian | 292/224 |
| 2,952,150 | 9/1960 | Matzkin et al. | 70/451 |
| 2,962,320 | 11/1960 | Gilbert | 70/451 X |

(List continued on next page.)

OTHER PUBLICATIONS

Southco Inc., *Southco Fasteners Handbook* 37, Concordville, Pa. 19331, date unknown.

Eberhard Manufacturing Co., *Handbook of Latches, Locks, Hinges, Handles, and Related Hardware, No.* 103, Cleveland, Oh. 44136, 1985.

Adams Rite Manufacturing Co., *Hardware For Glass Doors That Swing or Slide,* City of Industry, Calif. 91749, Jan. 1988.

*Primary Examiner*—Gary L. Smith
*Assistant Examiner*—Suzanne L. Dino
*Attorney, Agent, or Firm*—David A. Burge

[57] ABSTRACT

Flush mountable latches and locks for industrial cabinets, tool carts, electrical equipment enclosures and the like utilize versatile housings of novel configuration together with push-to-operate handles that are pivotally movable relative to the housings to effect unlatching movements of spring-biased, pivotally mounted latch bolts. The lock-type embodiment has a locking mechanism that is mounted on the housing to selectively permit and prevent unlatching movements of its pivotal latch bolt. The resulting arrangement provides sturdy latch and lock assemblies that employ a small number of relatively movable parts that can be assembled, installed and serviced with ease.

34 Claims, 7 Drawing Sheets

U.S. PATENT DOCUMENTS

| | | | |
|---|---|---|---|
| 2,987,908 | 6/1961 | Pelcin | 70/146 |
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/208 X |
| 3,161,923 | 12/1964 | Crain | 292/228 X |
| 3,208,781 | 9/1965 | Appleberry | 292/228 X |
| 3,209,563 | 10/1965 | Pelcin | 70/146 |
| 3,209,564 | 10/1965 | Pelcin | 70/148 |
| 3,240,523 | 3/1966 | Heimann | 292/241 X |
| 3,338,610 | 8/1967 | Pelcin et al. | 292/126 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/DIG. 31 X |
| 3,550,412 | 12/1970 | Pitel et al. | 70/208 X |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,767,244 | 10/1973 | Plaw | 292/227 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 292/228 X |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 292/DIG. 31 X |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,365,831 | 12/1982 | Bourne | 292/210 X |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 292/DIG. 31 X |
| 4,492,394 | 1/1985 | Dignan | 292/64 |
| 4,498,319 | 2/1985 | Balducci et al. | 70/489 X |
| 4,510,779 | 4/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 292/DIG. 31 X |
| 4,679,835 | 7/1987 | Weinerman et al. | 292/197 |
| 4,683,736 | 8/1987 | Weinerman et al. | 70/208 |
| 4,693,503 | 9/1987 | Bisbing | 292/DIG. 31 X |
| 4,706,478 | 11/1987 | Swan et al. | 70/208 |
| 4,707,006 | 11/1987 | Garg et al. | 292/DIG. 31 X |

LATCH AND LOCK ASSEMBLIES WITH SPRING-BIASED PIVOT BOLTS

The present application is a continuation-in-part of a co-pending application entitled Cabinet Lock with Recessed Handle, Ser. No. 859,194 filed Apr. 28, 1986 by Lee S. Weinerman et al as a continuation-in-part of application Ser. No. 601,648 filed Apr. 18, 1984 (now abandoned), which applications are referred to hereinafter as the "parent cases," the disclosures of which are incorporated herein by reference. Application Ser. No. 859,194 issued Aug. 4, 1987 as U.S. Pat. No. 4,683,736.

CROSS-REFERENCE TO RELATED APPLICATIONS

Reference is made to the following related, concurrently-filled applications, the diclosures of which are incorporated herein by reference:

Latch and Lock Housings, Handles and Mounting Brackets, Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

Latch and Lock Assemblies with Spring-Biased Slide Bolts, Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

Latch and Lock Assemblies with Lift and Turn Handles, Ser. No. 072,175, filed July 10, 1987 by Lee S. Weinerman, Frank R. Albris, Thomas V. McLinden and Timothy H. Wentzell, hereinafter referred to as the "Utility Case IV;"

Latch and Lock Assemblies with Expansible Latch Elements, Ser. No. 072,250, filed July 10, 1987 by Lee S. Weinerman, Steven A. Mayo, Thomas V. McLinden and Timothy H. Wentzell, hereinafter referred to as the "Utility Case V;"

Housings for Latches and Locks, Ser. No. 072,282, filed July 10, 1987 by Richard H. Russell, David W. Kaiser and Richard M. O'Grady, hereinafter referred to as the "Design Case I;"

Combined Housings and Handles for Latches and Locks, Ser. No. 072,283, filed July 10, 1987 by Richard H. Russell, David W. Kaiser and Richard M. O'Grady, hereinafter referred to as the "Design Case II;"

Combined Housings and Handles for Latches and Locks, Ser. No. 072,285, filed July 10, 1987 by Richard H. Russell and David Kaiser, hereinafter referred to as the "Design Case III;"

Combined Housings and Handles for Latches and Locks, Ser. No. 072,284, filed July 10, 1987 by Richard H. Russell and David W. Kaiser, hereinafter referred to as the "Design Case IV;"

Combined Housings and Handles for Latches and Locks, Ser. No. 072,276, filed July 10, 1987 by Richard H. Russell and David Kaiser, hereinafter referred to as the "Design Case V;"

Combined Housings and Handles for Latches and Locks, Ser. No. 072,573, filed July 10, 1987 by Richard H. Russell and David W. Kaiser, hereinafter referred to as the "Design Case VI;"

Combined Housings and Handles for Latches and Locks, Ser. No. 072,277, filed July 10, 1987 by Richard H. Russell and David W. Kaiser, hereinafter referred to as the "Design Case VII;"

Mounting Brackets for Latches and Locks, Ser. No. 072,278, filed July 10, 1987 by Richard H. Russell and Thomas V. McLinden, hereinafter referred to as the "Design Case VIII;"

Mounting Brackets for Latches and Locks, Ser. No. 072,280, filed July 10, 1987 by Richard H. Russell and Thomas V. McLinden, hereinafter referred to as the "Design Case IX;"

Strikers for Use with Latches and Locks, Ser. No. 072,279, filed July 10, 1987 by Lee S. Weinerman and Steven A. Mayo, hereinafter referred to as the "Design Case X;" and, Strikers for Use with Latches and Locks, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize a highly versatile housing together with other interactive components of novel form to provide desired types of latching and locking actions.

2. Prior Art

Flush mounted latches and locks including a body, a latch bolt movably carried on the body, and an operating handle that is nested by the body are well known. Normally the handle is in a flush or nested position when the bolt is in a latched position; and unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pat. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to the Eastern Company, a corporation of Connecticut.

Flush mounted latches and locks having latch bolts of other than the spring-projected, slide-mounted type are disclosed in such U.S. Patents as U.S. Pat. Nos. 4,413,849, 4,320,642, 4,312,203, 4,134,201, 3,857,594, 3,338,610, 3,044,814, 3,044,287 and 2,735,706, all of which are assigned to the Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

3. The Cross-Reference Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is referenced in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Parent Cases

The referenced Parent Cases discloses a simple means for retaining a key cylinder assembly in a lock housing. The lock housing has a generally cylindrical opening formed therethrough that extends along an axis for mounting a key cylinder assembly for rotation about the axis. Axially extending grooves are formed in an internal wall that defines the cylindrical opening. One of the grooves (referred to as an "installation groove") extends rearwardly and opens through such rear wall portions of the housing as surround the cylindrical opening. The grooves serve the function of cooperating with key operated tumblers of the key cylinder assembly that project radially from opposed sides of the key cylinder assembly to selectively permit and prevent rotation of the key cylinder assembly relative to the housing. The installation groove serves the function of permitting an offset projection that is carried on the back of the key cylinder assembly to be inserted completely through the cylindrical opening of the housing and the key cylinder assembly is installed in the cylindrical opening. Once the key cylinder assembly is installed, it is rotated to position the offset projection out of alignment with the installation groove so that the offset projection extends in overlying relationship with such rear wall portions of the housing as surround the cylindrical opening in which the key cylinder assembly is installed. By this arrangement, so long as the key cylinder is prevented from rotating relative to the housing to a position where the offset projection aligns with the installation groove, the offset projection serves to retain the key cylinder assembly in place on the housing.

As will be explained in greater detail, the type of housing features that are described above, and that also are also disclosed in the referenced Parent Cases, are utilized in the preferred practice of the present invention. For this reason, the present application is being filed as a continuation-in-part, with the benefits of the filing dates of the referenced Parent Cases being claimed.

SUMMARY OF THE INVENTION

The present invention provides novel and improved flush mountable latches and locks for industrial cabinets, tool carts, electrical equipment enclosures and the like, with the latches and locks utilizing a highly versatile housing together with other interactive components of novel form to provide desired types of latching and locking actions.

A latch or lock embodying the preferred practice of the present invention includes a one-piece housing on which are mounted other interactive components that provide a variety of desired features. As will become apparent from the description that follows, the versatile housing that is used with latches and locks that embody the preferred practice of the present invention provides a rigid, sturdy base structure for securely supporting latch and lock components. Latches and locks that embody the preferred practice of the present invention advantageously employ small numbers of relatively movable parts that can be assembled and serviced with ease.

The versatile housing on which other operating components are mounted preferably is formed from a suitable thermoplastics material such as a glass reinforced polycarbonate based polymer blend, which provides a dimensionally stable, impact resistant structure that is rigid, strong and can be readily machined as may be needed to provide mounting formations for movably mounting operating handles of a wide variety of types. The molded housing defines a pan-shaped structure that has a forwardly facing recess for nesting an operating handle. A pair of threaded mounting studs have enlarged head portions that are embedded in the molded material of the housing so that the threaded studs project rearwardly from a back wall of the housing for receiving mounted posts that are theaded onto the studs for mounting latch and lock operating components, and for establishing connections with a mounting bracket.

A feature of the latch and lock units that embody the preferred practice of the present invention resides in their use of a pivotal latch member that is "slammable" into engagement with a striker of novel configuration, with the striker serving to pivot the latch bolt from its unlatched position to its latched position. Another feature resides in the configuration of the pushhandle that enables the handle to cooperate with the latch bolt so that the handle will be held out of its normal nested position by virtue of its engagement with the latch bolt when the latch bolt is unlatched. A further feature resides in the use of springs that act independently on the handle and on the latch bolt to cause the handle to be biased toward its normally nested position, and to cause the latch bolt to be biased toward its unlatched position.

While latch and lock structures that embody the preferred practice of the present invention have latch bolts of the pivoted latch bolt type, not all of the features of the invention are limited to use with locks and latches that have pivoted latch bolts, as will be apparent to those skilled in the art from the description and claims that follow.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
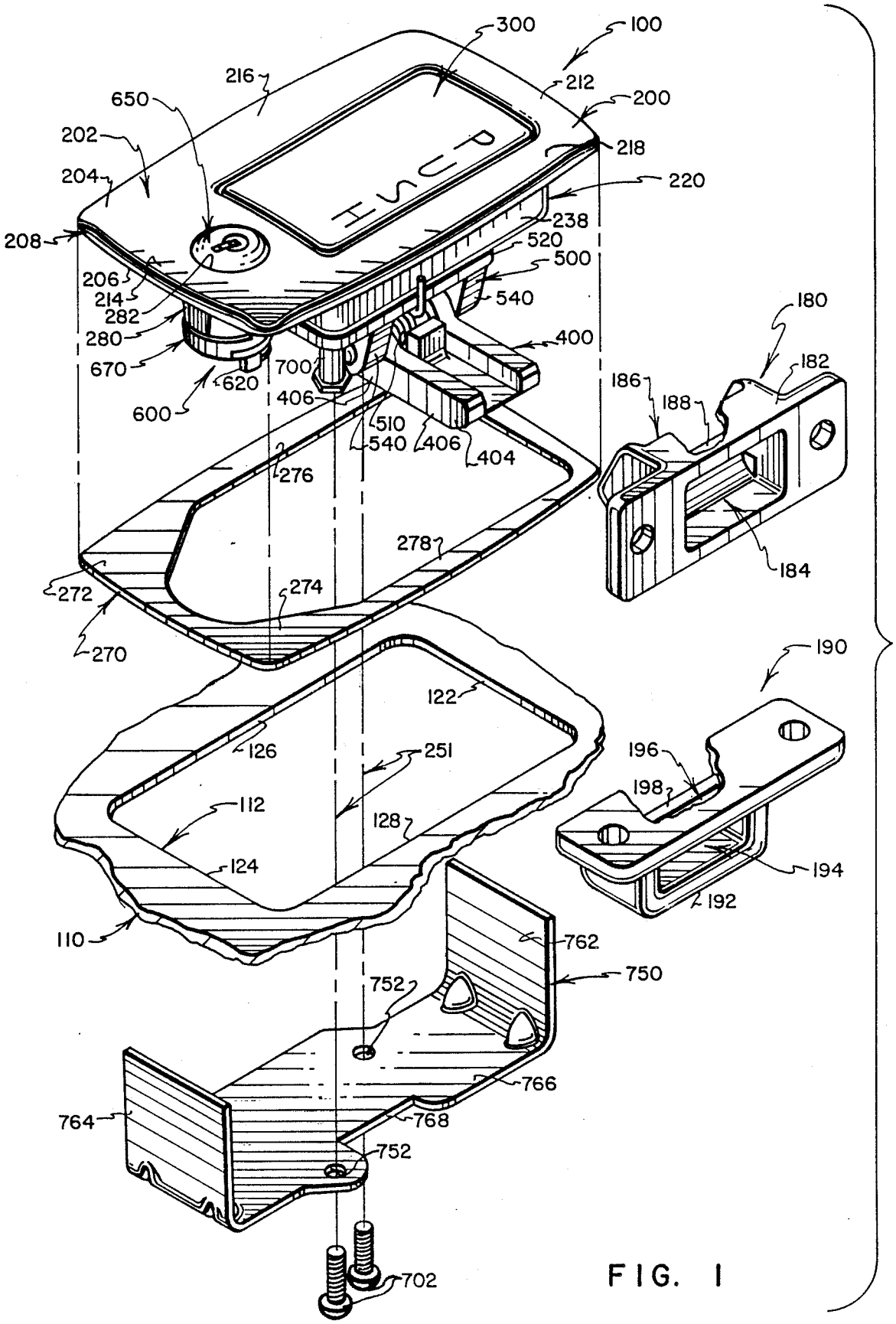
FIG. 1 is an exploded perspective view of one form of lock assembly that embodies features of the preferred practice of the present invention, illustrating how the lock assembly is mounted on a closure, and showing two types of strikers that may be used with the lock assembly, with front surface portions of the strikers being broken away.

Referring to FIG. 1, one form of a snap-acting lock assembly that embodies features of the preferred practice of the present invention is indicated generally by the numeral 100. The lock assembly 100 has a housing 200 that mounts a plurality of interactive components that provide latching and locking functions.

In overview, and as will be explained in greater detail, the interactive components that are carried on the housing 200 principally include a handle 300 that is mounted on the housing 200 for movement between normal and operating positions; a spring-pivoted latch bolt 400 that is mounted on the housing 200 for movement between latched and unlatched positions; a bracket and spring assembly 500 that mounts the latch bolt 400 on the housing 200 for movement between latched and unlatched positions, with movements of the latch bolt 400 to its unlatched position taking place in response to movement of the handle 300 to its operating position; and, a locking mechanism 600 for selectively permitting and preventing unlatching movement of the latch bolt 400 by the handle 300. If the locking mechanism 600 is omitted, the lock assembly 100 is thereby transformed into a latch assembly, i.e., a unit which has a handle 300 that always can be operated to retract the latch bolt 400.

Appearance features of the combined housing and handle (i.e., the housing 200 and the handle 300) are shown in greater detail in the referenced Design Case VI.

Referring to FIG. 1, it will be seen that the latch bolt 400 projects relatively sidewardly with respect to the housing 200 for engaging a suitably configured striker such as the strikers 180, 190 that are depicted in FIG. 1; however, those skilled in the art will understand that other types of strikers, as well as keeper formations of conventional, commercially available configurations, also may be used to engage and releasably retain the latch bolt 400.

The strikers 180, 190 have body structures 182, 192 that surround and define bolt-receiving chambers 184, 194, respectively. Openings 186, 196 are formed in the body structures 182, 192 and communicate with the chambers 184, 194, respectively. The openings 186, 196 are of adequate size to receive and releasably retain a tip portion of the latch bolt 400. Latch bolt engagement surfaces 188, 198 extend along one side of their associated openings 186, 196. Appearance features of the striker 180 are disclosed in greater detail in the referenced Design Case X. Appearance features of the striker 190 are disclosed in greater detail in the referenced Design Case XI.

Figure 2:
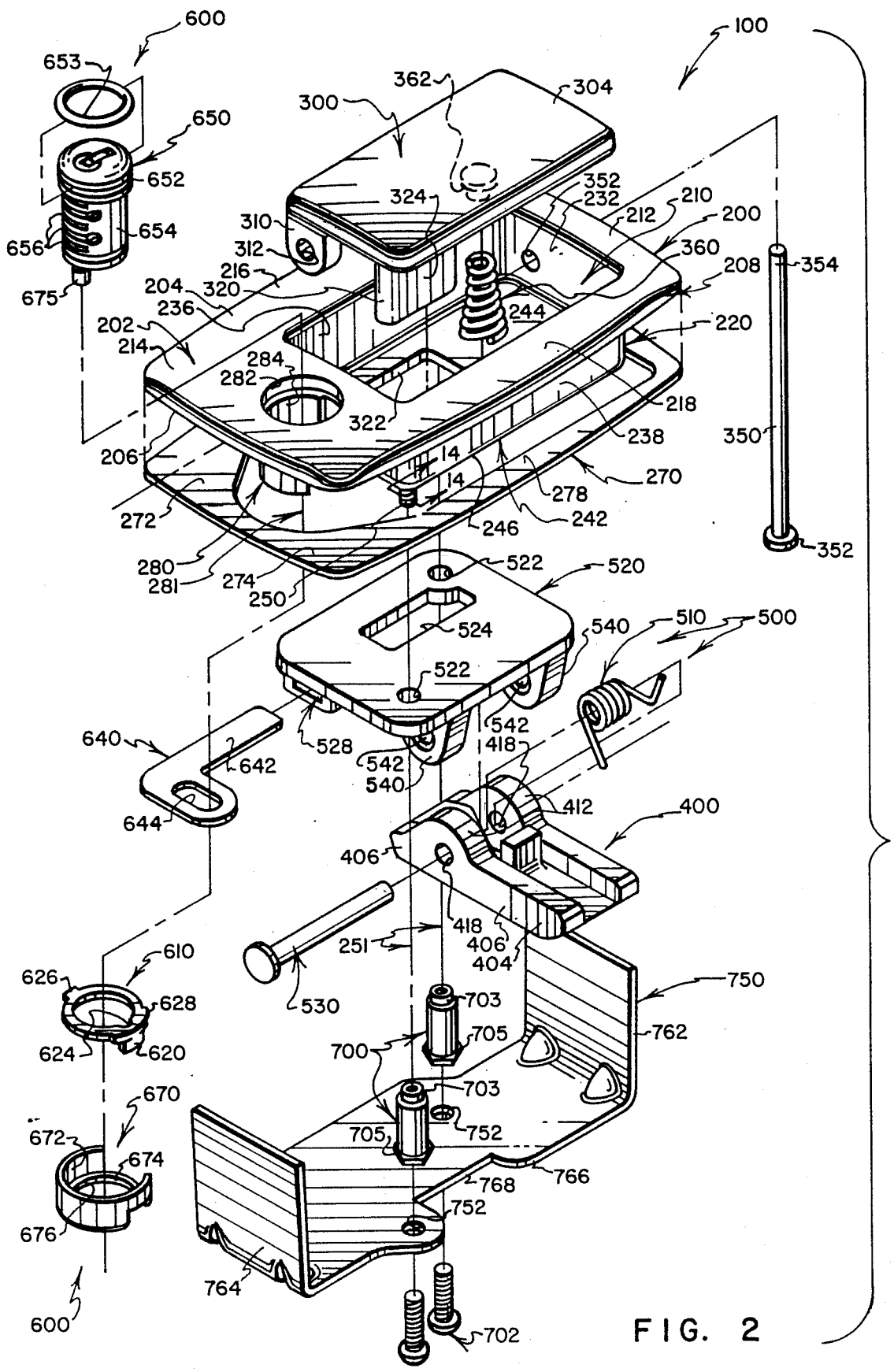
FIG. 2 is an exploded perspective view of components of the lock assembly of FIG. 1.
Figure 3:
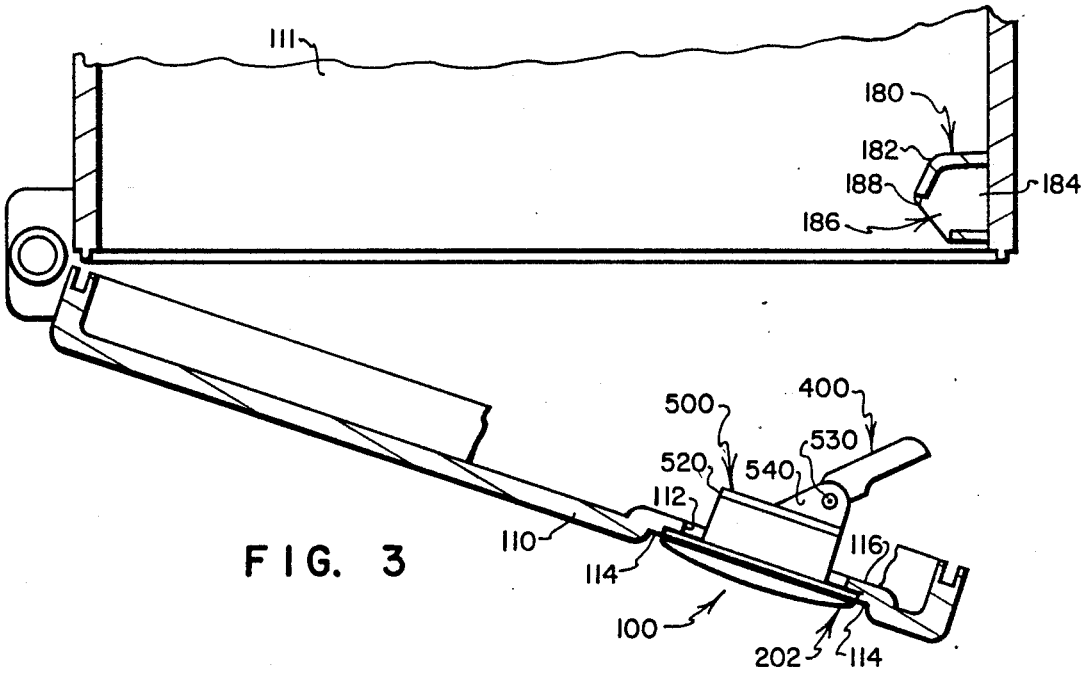
FIG. 3 is a schematic top plan view, on a reduced scale, showing the lock assembly of FIG. 1 installed on a pivotal closure, with a striker shown in cross section and mounted on a cabinet wall, and with the closure in an open position.
Figure 4:
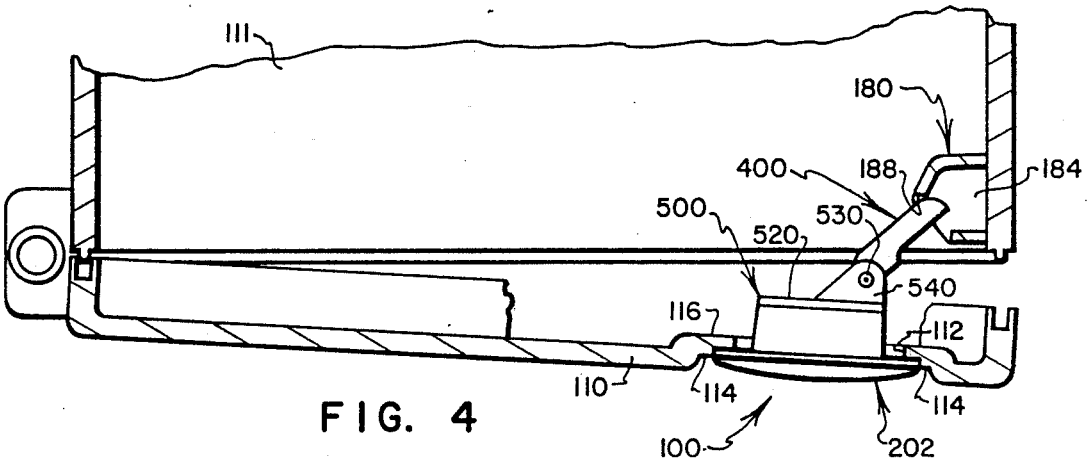
FIG. 4 is a schematic top plan view similar to FIG. 3 but with the closure moved toward its closed position to bring a rearwardly projecting latch bolt of the lock assembly into engagement with the striker.
Figure 5:
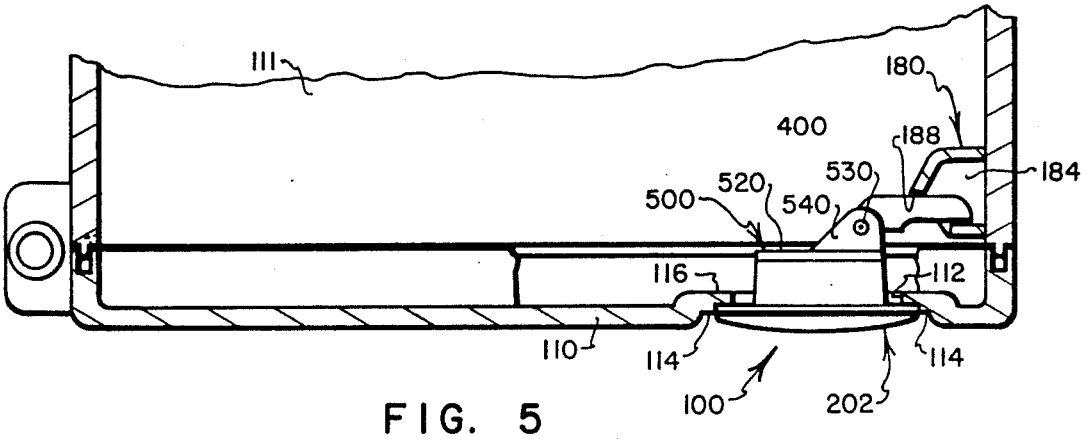
FIG. 5 is a schematic top plan view similar to FIGS. 3 and 4, but with the closure closed, and with the latch bolt in latched engagement with the striker.
Figure 6:
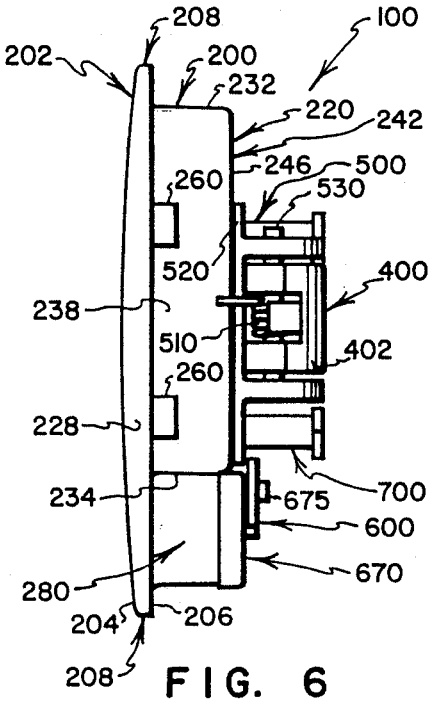
FIG. 6 is a right side elevational view thereof, with the handle in its normally nested position, with the latch bolt pivoted to its latched position, and with locking components locked.

The manner in which the latch bolt 400 of the lock assembly 100 cooperates with the striker 180 as the closure 110 is pushed to its closed position is depicted in the schematic top views of FIGS. 3–5. Referring to FIG. 3, when the closure 110 is open with respect to a cabinet structure 111 on which the closure 110 is pivotally mounted, the latch bolt 400 of the lock assembly 100 is pivoted (under the action of a torsion coil spring 510 that is shown in FIG. 2) to an unlatched position, i.e., to a position wherein the latch bolt 400 projects rearwardly and rightwardly as viewed in FIG. 3.

As the closure 110 is pivoted progressively towards its closed position, the latch bolt 400 is brought into engagement with the striker engaging surface 188 of the striker 180, as is shown in FIG. 4. Completion of the pivotal movement of the closure 110 to its closed position causes the engagement of the latch bolt 400 with the striker surface 188 to pivot the latch bolt 400 (in opposition to the action of the torsion spring 510) to the latched position of the latch bolt 400, as is shown in FIG. 5. As the latch bolt reaches its latched position, the handle 300 pivots to its normally nested position (under the influence of a compression coil spring 360 that is shown in FIG. 2). When the handle 300 pivots to its normally nested position, a rearwardly extending projection 320 of the handle 300 moves into a position of retaining engagement with an end region 402 of the latch bolt 400 to hold the latch bolt 400 in its latched position (as is depicted schematically in FIG. 11).

Figure 12:
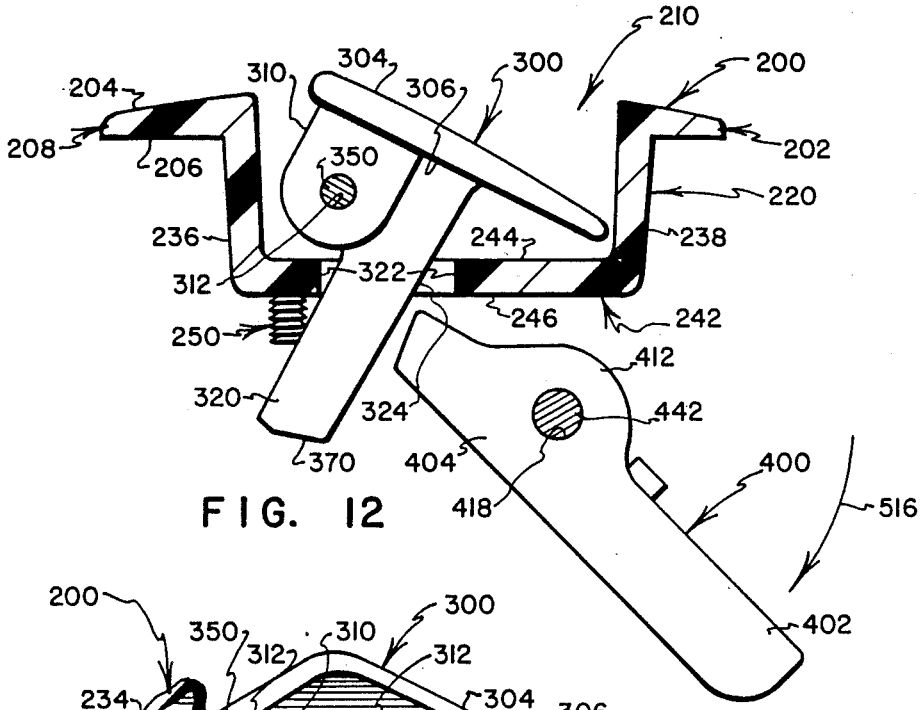
FIG. 12 is a schematic view similar to FIG. 11, but showing the handle fully pivoted out of its nested position, and with the latch bolt unlatched.

Unlatching of the lock assembly 100 is effected by depressing the handle 300, as is depicted schematically in FIG. 12. Pivotal movement of the handle 300 to its operated position moves the projection 320 out of retaining engagement with the latch bolt end region 402, whereupon the latch bolt 400 pivots under the action of the torsion coil spring 510 to its unlatched position, as is depicted in FIG. 12. As the latch bolt 400 pivots to its unlatched position, the engagement between the latch bolt 400 and the striker surface 188 causes the closure 110 to be "popped open" to the position shown in FIG. 4.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. More extensive portions of the closure 110 are depicted schematically in FIGS. 3–5, as is associated cabinet structure 111. The closure portion 110 has a front surface 114 and a rear surface 116 that extend about the perimeter of the opening 112. As is best seen in FIG. 1, the opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. A notch 768 is formed in one side of the back wall 760 to provide a clear, unobstructed path of movement for the latch bolt 400. Appearance features of the mounting bracket 750 are disclosed in greater detail in the referenced Design Case VIII.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110, and with the notch 768 overlying the bolt 400. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 720, to clamp the gasket 720 into engagement with the front surface 114, and to clamp the legs 762, 764 into engagement with the rear surface 116.

Figure 9:
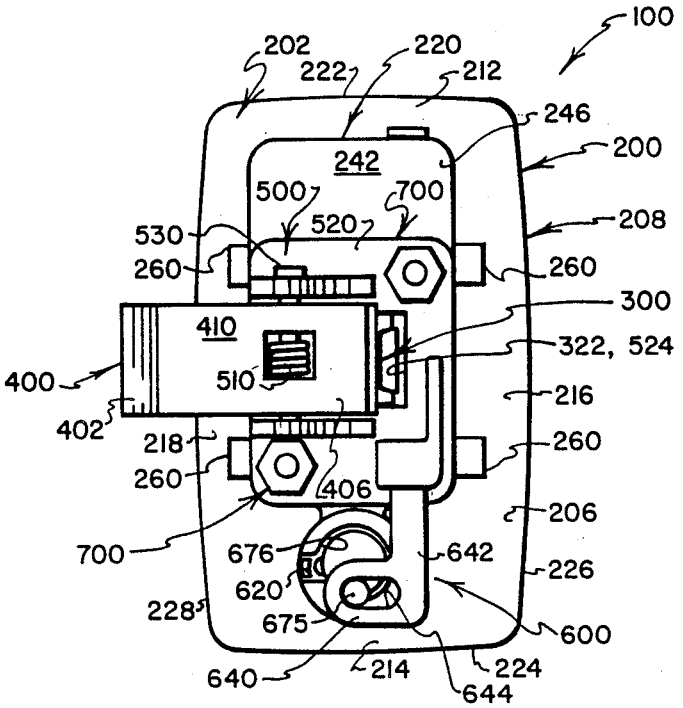
FIG. 9 is a rear elevational view similar to FIG. 7 but with the locking components unlocked.
Figure 10:
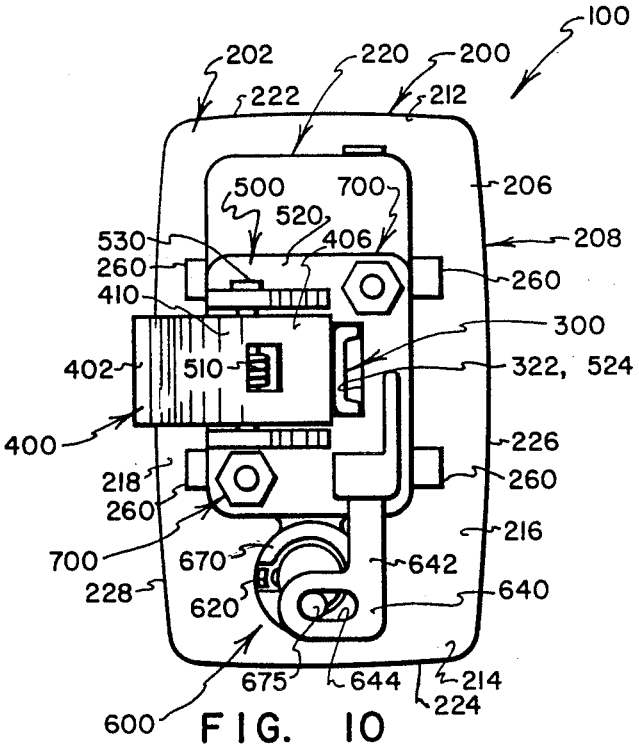
FIG. 10 is a rear elevational view similar to FIG. 9 but with the latch bolt pivoted to its unlatched position, and with the handle being held out of its nested position by the latch bolt.

To facilitate an understanding of the various relative positions of the principal relatively movable components of the lock assembly 100, reference is made to FIGS. 1 and 6–8 wherein the components of the lock assembly 100 are arranged such that: the handle 300 is in its "normal" or "nested" position; the latch bolt 400 is in its "latched" or "projected" position; and the lock mechanism 600 is "locked" so as to prevent unlatching movement of the latch bolt 400 in response to attempted operation of the handle 300. In FIG. 9, the mechanism of the lock 600 is shown "unlocked" so as to permit unlatching movement of the latch bolt 400 by operation of the handle 300. In FIGS. 10 and 12, the handle 300 is shown in its "operating" position wherein the handle 300 functions to permit the latch bolt 400 to pivot to its "unlatched" position.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing 200 as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, Mass. 01201 under the registered trademark Xenoy. The most preferred resin blend is about 10 percent glass reinforced, and is selected from the "6000 Series" of the Xenoy products sold by General Electric, with Xenoy 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

The mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important function of mounting other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decrease progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is relatively narrow.

Figure 7:
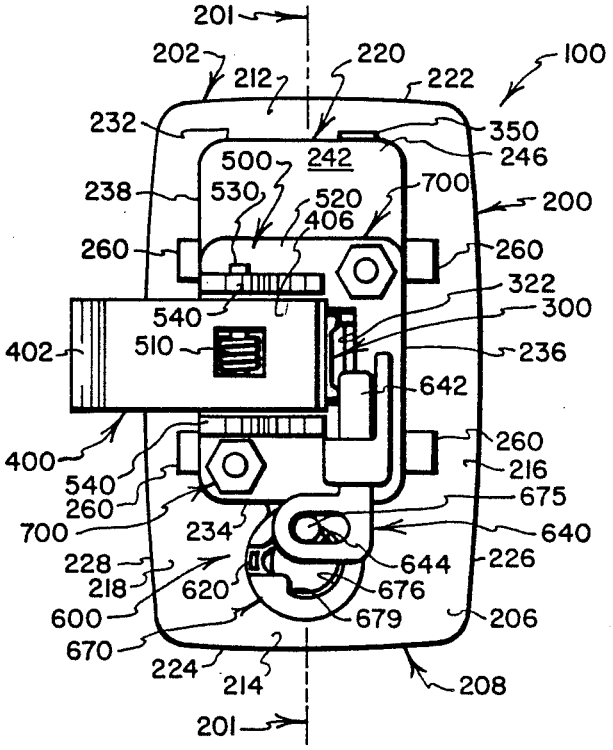
FIG. 7 is a rear elevational view thereof.
Figure 8:
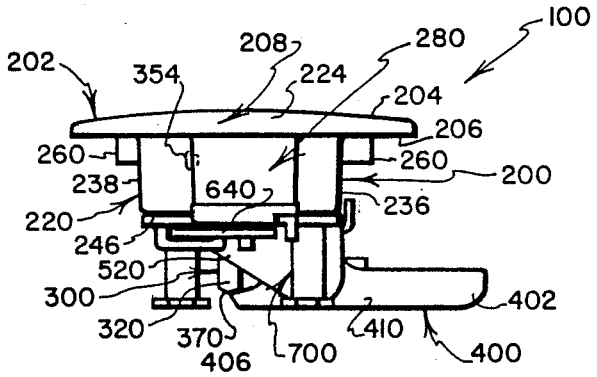
FIG. 8 is a bottom plan view thereof.

A feature of the present invention resides in the provision of compact, simply configured locks and latches having pivotal latch bolts, with the functional, operating components thereof being arranged substantially symmetrically about an imaginary, vertically extending center plane designated in FIG. 7 by the numeral 201. In this regard, it will be understood that several functional features of the housing 200 are arranged substantially symmetrically about the center plane 201, including the side walls 236, 238 of the housing portion 220, and a sleeve-like housing formation 280, which will be described.

With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Figure 14:
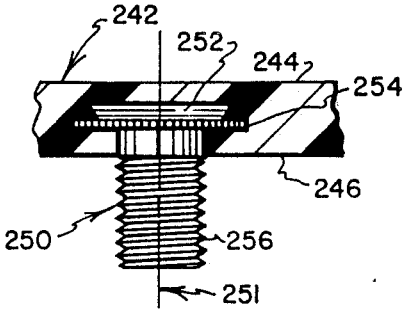
FIG. 14 is a sectional view, on an enlarged scale, as seen from a plane indicated by a line 14—14 in FIG. 2.

Threaded studs 250 project rearwardly from the rear face 246 of the back wall 242 for mounting various latch and lock components, as will be explained. Referring to FIG. 14, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the plastics material and will not rotate with thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

In the preferred practice, the threaded studs 250 are commercially available fasteners that are sold by Penn Engineering and Mfg. Corp. of Danboro, Pa., under the trademark Pem. The preferred part is model number CHN-832-4, which is formed from stainless steel, has a tapered head 252 with a maximum diameter of about 0.289 inch, has radially extending projecting portions 254 that have a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Locator projections 260 are provided at spaced locations along the side walls 236, 238 at junctures of the side ewalls 236, 238 with the rear face 206 of the mounting flange 202. As will be seen in FIG. 7, the locator projections 260 are arranged symmetrically in pairs on opposite sides of the center plane 201. The locator projections 260 are intended to directly engage opposite sides 126, 128 of the opening 112 (see FIG. 1) to orient the lock assembly 100 properly on the closure 110; however, if the opening 112 has been formed so as to be slightly "oversized," the locator projections 260 may be utilized during installation of the lock assembly 100 on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

While the gasket 270 is not essential in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside-out" manner. Specifically, referring to FIGS. 1 and 2, the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large, generally triangular-shaped corner region 272 that is configured to underlie a correspondingly large corner portion of the bottom wall 214 of the mounting flange 202, and a relatively smaller, generally triangular shaped corner region 274 that is configured to underlie a correspondingly smaller corner portion of the bottom wall 214 of the mounting flange.

Figure 15:
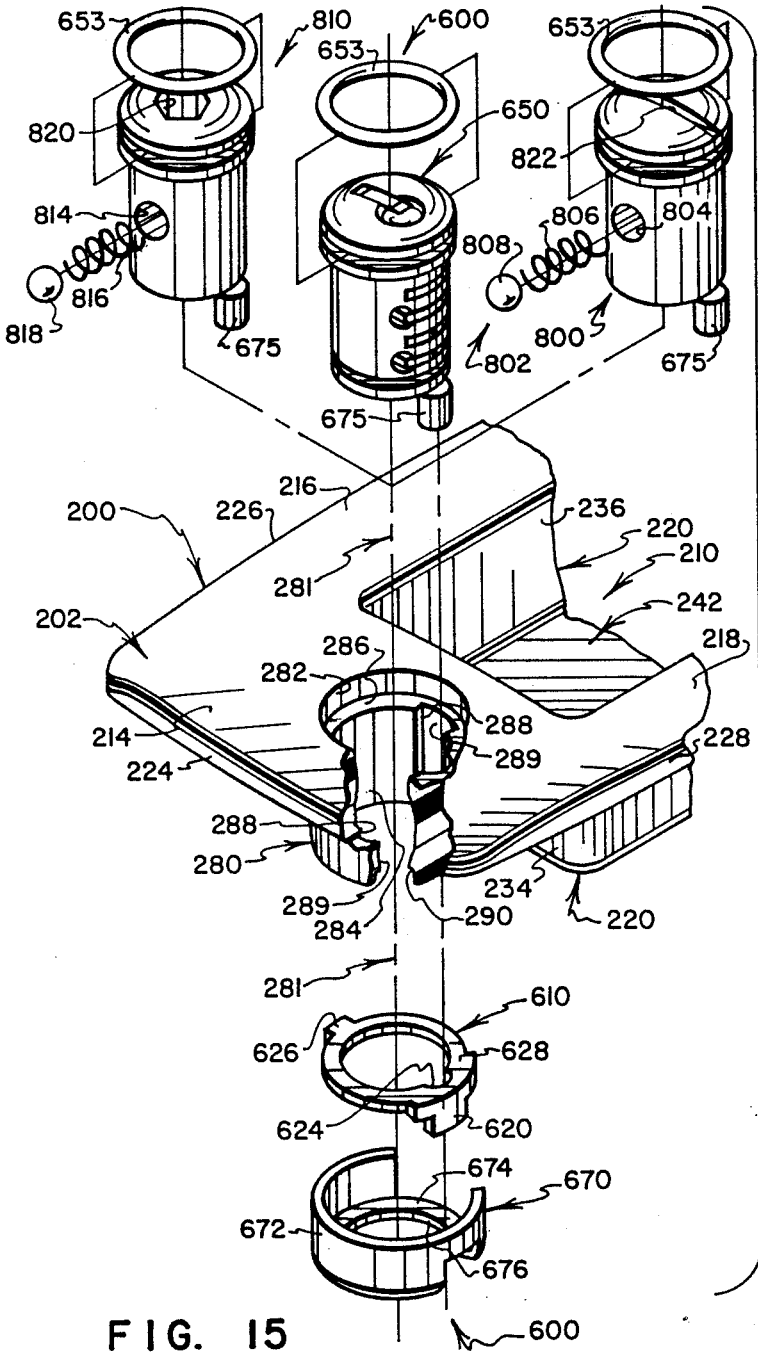
FIG. 15 is an exploded perspective view showing selected portions of the lock assembly, with alternate forms of a rotary plug that is insertable into the housing being shown.

Referring to FIGS. 2 and 15, the sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 that lies within the imaginary center plane 201 (see FIG. 7) and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figure 18:
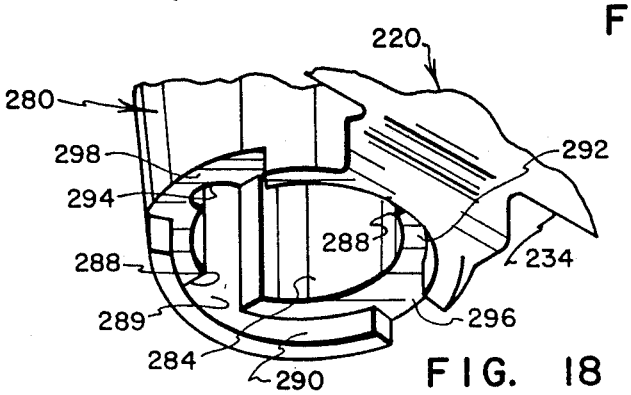

Referring to FIGS. 15 and 18, features of the sleeve formation 280 are shown on an enlarged scale. A shoulder 286 extends substantially radially with respect to the axis 281 to form a transition between the relatively large diameter of the opening 282 and the relatively smaller diameter of the passage 284. Axially extending top and bottom grooves 288 are formed in opposed upper and lower portions of the passage 284. The grooves 288 extend axially rearwardly from the shoulder 286 and have bottom walls 289 that are curved and represent continuations of a cylindrical surface 290 of enlarged diameter that is formed in the rearward end region of the sleeve 280. A radially extending shoulder 292 forms a transition between the passage diameter that is designated by the numeral 284, and the enlarged diameter end region 290. A rounded installation groove 294 of shallower depth than the grooves 288 is formed in a side of the passage portion 284. The rounded installation groove 294 extends from the shoulder 286 to the shoulder 292.

Referring to FIG. 18, two opposed portions 296, 298 of the shoulder 292 extend radially outwardly and interrupt opposed side portions of the sleeve formation 280 to provide radially extending, rearwardly opening notches that are designated by the numerals 296, 298.

Referring to FIGS. 1, 2, and 3, it will be understood that, in preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. Depending on the type of handle that is to be used with the housing 200, and on the type of latch or lock operating mechanism that is to be mounted on the housing 200, one or more suitable passages (such as a back wall opening 322 depicted in FIGS. 11–13) through the housing 200 are machined to provide openings, holes, slots and the like, as may be needed, which formed as by drilling, milling or other conventional machining techniques.

Figure 13:
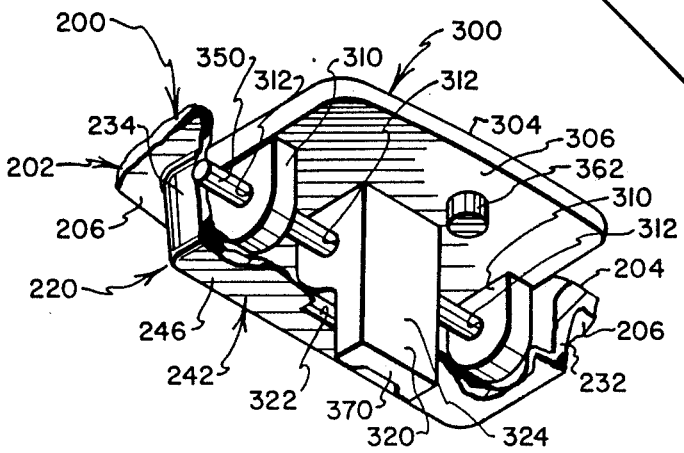
FIG. 13 is a perspective view of portions of the handle and housing, with housing portions broken away, with the handle in its normal nested position with respect to the housing, and with the view showing principally rear features thereof.

Referring to FIGS. 2 and 13, the handle 300 is formed from molded plastics material, preferably of the same thermoplastics material from which the housing 200 is formed. The handle 300 has a front surface 304 that is of complexly curved, generally convex shape, and is configured to extend in a flush, substantially contiguous manner to smoothly continue the curvature of the complexity curved, convex front surface 204 of the mounting flange 202 when the handle 300 is in its normal or nested position. The handle 300 has a back wall surface 306. The handle 300 is mounted on the housing 200 for movement between a normally nested position that is, shown in FIGS. 1, 5–9, 11 and 13 and an operating position that is depicted in FIGS. 10 and 12.

Figure 16:
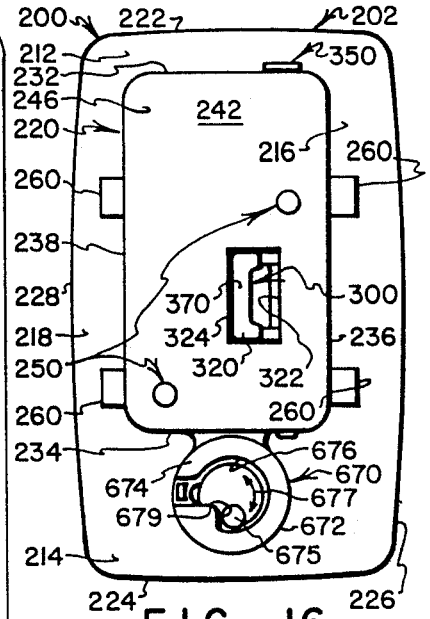
FIG. 16 is a rear elevational view of selected portions of the lock assembly showing a rotary plug or lock cylinder assembly in an unlocked position.
Figure 17:
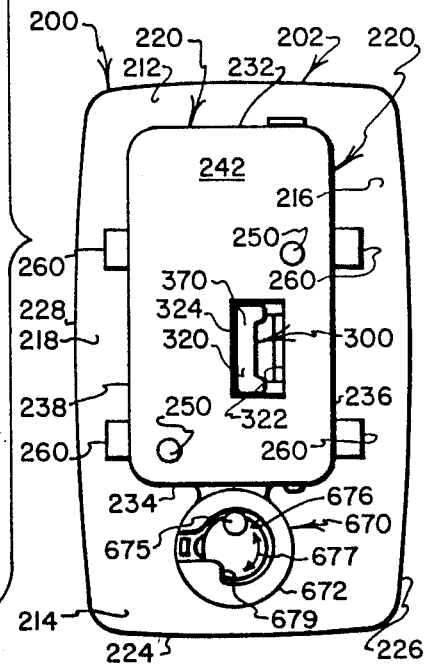
FIG. 17 is a rear elevational view similar to FIG. 16 showing the rotary plug or lock cylinder assembly in a locked position; and, FIG. 18 is a perspective view, on an enlarged scale of rear portions of the housing.

The handle 300 has a generally rectangular shape and a size that lets the handle 300 nest and move with ease within the confines of the recess 210. The handle 300 has mounting portions 310, that have aligned holes 312 formed therethrough. The handle 300 has a rearwardly extending projection 320 that extends through a hole 322 that is formed in the back wall 242 of the housing 200. A stop surface 324 is provided on the projection 320. When the handle 300 is in its nested position, the stop surface 324 engages one side of the hole 322, as is shown in FIGS. 11, 16 and 17.

A mounting pin 350 extends through the aligned holes 312 that are formed in the mounting portions 310, and through aligned holes 352 (one is shown in FIG. 2) that are formed in the end walls 232, 234 of the housing 200 to pivotally mount the handle 300 on the housing. A compression coil spring 360 (see FIG. 2) is interposed between the back surface 306 and the back wall 242. One end region of the spring 360 is wrapped tightly about a projection 362 (see FIG. 13) that extends rearwardly from the back surface 306. The spring 360 biases the handle 300 toward its nested position.

Figure 11:
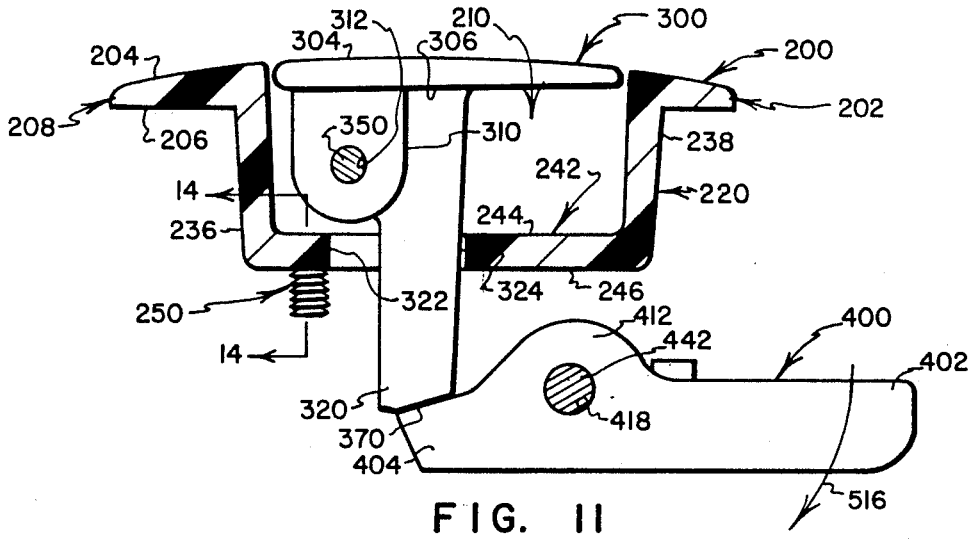
FIG. 11 is a schematic view, partially in cross section, on an enlarged scale, showing the handle in its normal nested position in relation to the housing, and showing the latch bolt latched, with the latch bolt being held in its latched position by its engagement with a rearwardly projection position of the handle.

As is best seen in FIGS. 11 and 12, the handle projection 320 has an end portion 370 that is engageable with the bolt 400 either to retain the bolt 400 latched (as is shown in FIG. 11) or to release the bolt 400 for movement to its unlatched position (shown in FIG. 12).

Referring to FIG. 2, the handle mounting pin 350 is formed from stainless steel stock of round cross section, and is provided with a head 352 at one end. The opposite end 304 of the pin 350 is clinched (see FIG. 8) after installation to hold it in place in the housing 200.

The latch bolt 400 is connected to the housing 200 by means of mounting plate and spring assembly 500 that is mounted on the back wall 242 of the housing 200 by the mounting posts 700. The latch bolt 400 is movable between a latched position shown in FIGS. 1, 5–9 and 11) and an unlatched position (shown in FIGS. 10 and 12).

Referring to FIGS. 2, 11 and 12, the latch bolt 400 is an elongate member of generally rectangular configuration having a left end region 402 that is engageable with the handle projection 320, a right end region 406 that is engageable with the striker surfaces 188, 198, and a central region 410 that interconnects and extends between the end regions 402, 406. A pair of mounting formations 412 are provided on the central region 410. The mounting formations 410 border opposite sides of a slot 414 that is formed through the mounting plate within which a torsion coil spring 510 is carried.

Referring to FIG. 2, the torsion coil spring 510 and a mounting plate 520 are connected to the latch bolt 400 by a pivot pin 530. The pivot pin 530 extends through aligned holes 418 formed in the mounting formations 412, through coils of the spring 510, and through aligned holes 542 that are provided in a pair of upstanding mounts 540 that are formed integrally with the mounting plate 520.

The mounting plate 520 preferably is formed from the same thermoplastic material that is used to form the housing 200 and the handle 300. The mounting plate 520 is configured to engage the back wall 242 of the housing 200, and has holes 522 that receive the threaded studs 250. The mounting posts 700 have cylindrical portions 703 that extend into the holes 522 as the mounting posts 700 are threaded onto the studs 250 to clamp the mounting plate 520 in place on the housing 200. The mounting studs 700 have enlarged hex formations 705 that can be engaged by a nut driver or a wrench to tighten the mounting posts 700 in place on the studs 250.

A passage 524 is formed through a central region of the mounting plate 520 in alignment with the back wall opening 322 to receive the handle projection 320. The torsion spring 510 has opposite ends 512, 514 in engagement with the mounting plate 520 and the bolt 400 to bias the bolt in the direction of the arrow 516 as shown in FIGS. 11 and 12. When the latch bolt 400 is in its latched position, the end 402 of the latch bolt 400 is engaged by the end 370 of the handle projection 320 and is thereby held securely in its latched position. When the handle 300 is pivoted (as is shown in FIG. 12) to its operated position, the end 370 of the projection 320 disengages the latch bolt 400, and the latch bolt 400 pivots to its unlatched position under influence of the torsion coil spring 510. As the latch bolt 400 pivots to its latched position, the engagement between the latch bolt 400 and the striker surface 188 (see FIGS. 3–5) will cause the closure 110 to be forced open with something of a pop-open type of action.

Referring to FIGS. 2, 7 and 9, the locking system 600 includes a P-shaped member 640 that is slidably mounted by the mounting plate 520 for movement between a locked position shown in FIG. 7, and an unlocked position shown in FIG. 9. The P-shaped member 640 has an elongate stem portion 642 that is carried slidably carried in a slide channel 528 that is defined by the mounting plate 520 (see FIG. 2). When the locking system 600 is locked, the stem portion 612 of the P-shaped member overlies a portion of the opening 524 (see FIG. 2) and prevents the handle projection 320 from moving away from the bolt retaining position illustrated in FIG. 11. When the P-shaped member 640 is slid to its unlocked position, however, as is shown in FIG. 9, movement of the handle projection 320 is no longer obstructed and the handle 300 can be operated to effect unlatching movement of the latch bolt 400.

Referring to FIG. 15, the manner in which the key cylinder assembly 650 is installed in the housing opening and passage 282, 284 is to align the offset projection 675 of the key cylinder assembly with the installation groove, whereupon the key cylinder 650 assembly can be inserted into the opening 282 and into the passage 284, with the offset projection 675 traveling entirely a through the length of the installation groove 294, 624 so as to extend rearwardly behind the sleeve formation 280 of the housing 200 and behind the insert 610, whereupon the key cylinder assembly 650 then is rotated to position the offset projection 675 out of aligment with the installation groove 294, 624 whereupon the key cylinder assembly 650 is retained in the housing 200 by virtue of the offset projection's overlying rear surface portions of the insert 610 that surrounds the key cylinder 650.

Two motion-limiting components of the locking assembly 600 cooperate to keep the offset projection from re-aligning with the installation groove. One of the motion-limiting components is the P-shaped locking member 640 that is slidably mounted on the mounting plate 520. The P-shaped locking member 640 has a cut-out slot 644 that fits over the offset projection 675, with the length of the slot 644 and the sliding path of movement of the P-shaped member 640 (as defined by the mounting plate 520) being such as to confine movements of the offset projection 675 to a range of rotary movement that excludes the installation groove portions 294, 624.

Referring to FIGS. 2 and 15–17, the other of the motion-limiting components is a rotation limiting cap 670 is installed on the rear end region of the sleeve-like portion 280 of the housing 200 after the ring-like insert 610 has been bonded in place on the housing 200. The cap 670 has generally cylindrical skirt 672 that extends about the periphery of the rear end region of the sleeve-like portion 280, and has a washer-like end 674 that overlies rear surface portions of the sleeve 280 and the insert 610. Parts of the skirt and the end are cut out to receive the rearwardly extending projection 620 of the insert 610. The skirt 672 has a cut away portion to accommodate the juncture of the sleeve 280 with the bottom wall 234 of the pan-shaped housing portion 220.

The cap 670 has a cut-out central portion 676 through which the offset projection of the key cylinder assembly extends. As is best seen by comparing the "unlocked" and "locked" positions of the offset projection 675 as depicted in FIGS. 16 and 17, respectively, it will be seen that the cut out central portion 676 does nothing to inhibit a 180 degree range of rotary movement of the offset projection 676 between its unlocked and locked positions, with this movement taking place along a path of travel that is indicated by an arrow 677; however, clockwise movement of the offset projection ("clockwise" as viewed in FIGS. 16 and 17) from the locked position (shown in FIG. 17) to the unlocked position (shown in FIG. 16) is halted by a stop surface 679 if an effort is made to continue such rotation beyond the unlocked position. By this arrangement, the cap 670 cooperates with other components of the locking system 600 to keep the offset projection 675 from being brought into alignment with the installation groove.

In place of the key cylinder assembly, plug members 800, 810 that have substantially the same general shape as the key cylinder assembly 650 can be installed in the opening and passages 282, 284 to function like the key cylinder assembly 650 except that no key is required to effect their rotation. Instead, a tool receiving formation such as a hex driver receiving opening 820, or a flat groove 822 for receiving a screwdriver blade is provided in outer end regions of the plug members 800, 810 as is depicted in FIG. 15.

Ball detents 802, 812 can be provided in the plug members 800, 810 as by forming radially extending passages 804, 814 into which are inserted compression coil springs 806, 816 and balls 808, 818. The balls 808, 818 are operative to engage the grooves 288 to prevent unwanted rotary movement of the plugs 800, 810.

Regardless of whether a key cylinder assembly or a plug is installed in the opening and passage 282, 284, an O-ring 653 preferably is installed in a groove that is formed around the circumference of an enlarged diameter head portion of the key cylinder 650 and the plugs 800, 810 to engage the interior wall surfaces that define the opening 282 to prevent unwanted moisture from passing therethrough.

A ring-like insert 610 is provided for positioning in the rear end region of the sleeve portion 280 of the housing 200. The insert 610 serves the function of closing rear end regions of the top and bottom grooves, 288 and of defining a rearwardly extending stop projection 620 for limiting the range of rotary movement of certain locking members that can be used as a part of the locking system 600.

In order to provide an extension of the rounded groove 294 through the ring-like insert 610, a rounded groove portion 624 is provided in the insert 610 and is aligned with the rounded groove 294 of the sleeve member 280. In order to properly align the ring-like insert for mounting on the housing, a pair of radially extending formations 626, 628 are provided to engage the grooves 296, 298 that are formed at the rear end of the sleeve member 280. The groove 296 and the formation 626 are of relatively small size and are configured to mate in a close slip fit. The groove 298 and the formation 628 are of relatively larger size and are configured to mate in a close slip fit. The difference in sizes of the mating components 296, 626 and 298, 628 prevents inadvertent switch mating of these similarly configured parts. The positioning of the relatively larger formation 628 as well as the rearwardly extending projection 620 at location adjacent the area of the ring-like insert 610 that is structurally weakened by the provision of the rounded groove 624 serves to strengthen this area of the ring-like insert 610.

Although the invention has been described in its preferred form with a certain degree of particularity, it is understood that the present disclosure of the preferred form has been made only by way of example, and that numerous changes in details of construction as well as the combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A flush-mountable latch, comprising:

(a) housing means including a pan-shaped housing having a front wall, and having recess-defining wall formations that define a forwardly facing recess, with portions of the front wall forming a mounting flange that surrounds the recess;

(b) the housing being formed as a rigid, one-piece molded structure with the recess-defining wall formations including a back wall at the rear of the recess, with the back wall defining a rearwardly facing mounting surface;

(c) threaded fastener means rigidly connected to the back wall at spaced locations, including two threaded fasteners located near opposed sides of the mounting surface;

(d) handle means including a push-to-operate handle, and handle mounting means pivotally connecting the handle to the housing for movement relative to the housing between a non-operated position wherein the handle extends substantially flush with the front wall, and an operated position wherein at least a selected portion of the handle is pivoted inwardly with respect to the recess and toward the back wall of the housing;

(e) handle biasing means interposed between the handle means and the housing means for biasing the handle away from its operated position toward its non-operated position, with the housing means, the handle means and the handle biasing means cooperating to define a first spring-biased assembly;

(f) opening means formed through the recess-defining wall formations of the housing to establish a path of communication between the forwardly facing recess and a region that is located behind the back wall, including an opening that is formed through the back wall and opens through the mounting surface at a location between the two threaded fasteners;

(g) handle-connected means including a rearwardly extending projection of the handle for extending through the opening means, for extending into said region located behind the back wall, and for being moved within said region in response to movement of the handle between its non-operated and operated positions;

(h) housing bracket means for engaging the mounting surface of the back wall and for defining two spaced mounting formations that extend rearwardly from the back wall;

(i) latch bolt means including an elongate latch bolt that has a central region that extends between the rearwardly extending mounting formations, and latch bolt mounting means pivotally connecting the latch bolt to the rearwardly extending mounting formations for movement relative to the housing bracket means between latched and unlatched positions, with the elongate latch bolt having opposed end regions that are interconnected by the central region;

(j) latch bolt biasing means interposed between the latch bolt means and the housing bracket means for biasing the latch bolt away from its latched position toward its unlatched position, with the housing bracket means, the latch bolt means and the latch bolt biasing means cooperating to define a second spring-biased assembly;

(k) securing means for threadedly engaging the threaded fastener means so as to clamp the housing bracket means into engagement with the mounting surface to rigidly connect the first and second spring-biased assemblies such that one end region of the elongate latch bolt extends into overlying relationship with the opening that is formed in the back wall whereby, when the handle is in its non-operated position and the latch bolt is in its latched position, the rearwardly extending projection of the handle directly engages the one end region of the latch bolt to releasably retain the latch bolt in its latched position in opposition to the action of the latch bolt biasing means, and whereby, when the handle is pivoted to its operated position in opposition to the action of the handle-biasing spring, the one end region of the latch bolt is disengaged by the rearwardly extending projection of the handle so as to permit the latch bolt to pivot toward its unlatched position under the influence of the latch bolt biasing spring; and, (l) interengageable formation means carried on the rearwardly extending projection of the handle and on the one end of the latch bolt for permitting the handle to move to its non-operated position under the influence of the handle biasing means only when the latch bolt is in its latched position.

2. The latch of claim 1 wherein the front wall has a front surfact that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

3. The latch of claim 2 wherein the handle is formed as a rigid, one piece molded structure, the handle has a front wall that has a front surface, and the front surface of the handle is configured to extend contiguously with front surface portions of the housing when the handle is in its non-operated position.

4. The latch of claim 3 wherein the housing and the handle are formed from an injection molded, glass reinforced, polycarbonate based polymer blend thermoplastics material.

5. The latch of claim 1 wherein the handle means includes a rigid, handle formed as a rigid, one-piece molded structure.

6. The latch of claim 5 wherein the rearwardly extending projection of the handle is a rigid formation that is an integral part of the one-piece handle structure.

7. The latch of claim 1 wherein the latch bolt mounting means includes pivot pin means for extending through aligned holes that are formed in the two rearwardly extending formations of the housing bracket means and in the latch bolt means so as to pivotally connect the latch bolt to the housing bracket means.

8. The latch of claim 7 wherein the latch bolt biasing means includes a torsion coil spring having portions thereof extending around the pivot pin means, and having opposed end regions engaging the housing bracket means and the latch bolt, respectively, for biasing the latch bolt toward its unlatched position.

9. The latch of claim 1 wherein a rearwardly extending formation is provided on a back surface of the handle, and the handle biasing means includes a comprssion coil spring that is interposed between the handle and the housing for biasing the handle toward its non-operated position, with the spring having opposed end regions, with one of the end regions being reeved around portions of the rearwardly extending formation to connect the handle to the compression coil spring, and with the other of the end regions engaging the back wall of the housing.

10. The latch of claim 1 wherein:

(a) the housing has a generally cylindrical sleeve-like portion formed integrally with the front wall and defining a through passage that opens through the front wall, with the through passage having an inner wall surface that is of generally cylindrical configuration and extends concentrically about an imaginary axis that extends substantially perpendicularly to the common plane of the rearwardly facing mounting flange surface portions;

(b) at least one groove is formed in the inner wall surface of the through pasasge;

(c) a plug is configured to fit within the through passage and is journaled therein for rotation about the imaginary axis;

(d) an offset projection is connected to the plug and extends rearwardly therefrom at a location behind the rear wall of the plug, with at least a portion of the projection being offset from the imaginary axis so as to have a portion of the projection located radially outwardly beyond the inner wall of the pasasge; and, (e) the plug being insertable into the passage and being withdrawable therefrom only when the offset projection is in alignment with the groove so as to pass through the groove as the plug moves through the passage.

11. The latch of claim 10 wherein the locking member has a projection receiving formation that engages the rearwardly extending offset projection to drivingly interconnect the plug and the locking member so that the locking member is moved between its locked and unlocked positions in response to rotary movement of the plug between its locked and unlocked positions.

12. The latch of claim 11 wherein the inner cylindrical surface has at least one groove formed therein to receive tumblers of a key-operated locking plug to lock the locking plug against rotation, and the plug includes key-operated locking means that is responsive to the insertion of a key therein for selectively permitting and preventing rotation of the locking plug between locked and unlocked position.

13. The latch of claim 1 wherein:

(a) the housing bracket means defines a slide channel that extends alongside the opening that is formed through the back wall;

(b) the rearwardly extending handle projection is configured so as to reside toward one side of the back wall opening when the handle is nested, and to reside toward an opposite side of the back wall opening when the handle is moved to its operated position; and, (c) a locking member is positioned in the slide channel and is movable between locked and unlocked positions, with the locking member being configured such that when it is in its locked position it blocks movement of the rearwardly extending handle projection from the one side to the other side of the back wall opening, whereby the locking member blocks movement of the handle to its operated position when the locking member is in its locked position.

14. The latch of claim 1 additionally including striker means for engaging the latch bolt when the latch bolt is in its latched position, for pivoting the latch bolt from its unlatched position to its latched position as a closure on which the latch is mounted is moved into closed position wherein the latch bolt engages the striker means, and, for effecting pop-opening movement of the closure when the handle is operated to pivot the handle from its nested position to its operated position whereupon the latch bolt is released to move under the influence of the latch bolt biasing means to pivot from its latched position to its unlatched position.

15. The latch of claim 14 wherein:

(a) the striker means defines a bolt receiving chamber for receiving the latch bolt when the latch bolt is in its latched position, and a pair of engagement surfaces on opposite sides of an opening that extends into the bolt-receiving chamber;

(b) one of the engagement surfaces is configured to engage an end region of the latch bolt when the closure is being moved to its closed position, whereby the one striker engagement surface serves to engage the latch bolt to effect pivotal movement of the latch bolt to its latched position as the closure is being moved to its closed position; and, (c) the other of the striker engagement surfaces is configured to overlie the latch bolt when the latch bolt is in its latched position to prevent opening movement of the closure when the latch bolt is in its latched position.

16. The latch of claim 1 wherein the portion of the push-to-operate handle on which an operator is to push in order to move the handle from its nested position toward its operated position carries indicia to designate said handle portion to which force should be applied by the operator.

17. The latch of claim 16 wherein the indicia includes the work "PUSH."

18. The latch of claim 1 additionally including striker means configured to engage the latch bolt when a pivotally mounted closure on which the latch is mounted is moved toward its closed position wherein the latch bolt is brought toward a position of engagement with the striker means;

(a) the striker means including structure defining a latch bolt engagement surface for engaging the latch bolt as the latch bolt approaches the striker means during closing of the door, and for effecting rotation of the latch bolt from its unlatched to its latched position in response to complete movement of the closure to its closed position; and, (b) the striker means having formation means for releasably retaining the latch bolt in its latched position once the latch bolt has been received by the striker means and has moved to its latched position as the closure has completed its movement to its closed position.

19. A flush-mountable latch, comprising:

(a) a pan-shaped housing having a front wall, recess-defining wall formations that define a forwardly facing recess, with portions of the front wall forming a mounting flange that surrounds the recess, and with the housing having a locking plug mounting location defined at one end of the recess by a sleeve-like structure that has a through passage that opens through the front wall;

(b) the housing being formed as a rigid, one-piece structure from injection molded material, with the recess-defining wall formations including a back wall at the rear of the recess, with the back wall defining a rearwardly facing mounting surface, with two threaded mounting studs having portions embedded in the material of the back wall and having threaded stud portions that project rearwardly from the back wall at spaced locations near opposite side portions of the mounting surface;

(c) handle means including a push-to-operate handle, and handle mounting means for pivotally connecting the handle to the housing for movement relative to the housing from a nested position wherein the handle extends substantially flush with the front wall to an operated position wherein at least a selected portion of the handle is pivoted inwardly with respect to the recess and toward the back wall of the housing;

(d) handle biasing means interposed between the handle means and the housing means for biasing the handle away from its operated position toward its nested position, with the housing means, the handle means and the handle biasing means cooperating to define a first spring-biased assembly;

(e) opening means formed through recess-defining wall formations of the housing to establish a path of communication between the forwardly facing recess and a region located outside the recess and behind the back wall, including an opening that is formed through the back wall and that opens through the mounting surface at a location between the two threaded mounting studs;

(f) handle-connected means including a rearwardly extending projection of the handle for extending through the opening means, for extending into said region located behind the back wall, and for being moved within said region in response to movement of the handle between its nested and operated positions;

(g) housing bracket means for engaging the mounting surface of the back wall and for defining two spaced mounting formations that extend rearwardly from the back wall;

(h) latch bolt means including an elongate latch bolt that has a central region that extends between the rearwardly extending mounting formations, and latch bolt mounting means for pivotally connecting the latch bolt to the rearwardly extending mounting formations for movement relative to the housing bracket means between latched and unlatched positions, with the elongate latch bolt having opposed end regions that are interconnected by the central region;

(i) latch bolt biasing means interposed between the latch bolt means and the housing bracket means for biasing the latch bolt away from its latched position toward its unlatched position, with the housing bracket means, the latch bolt means and the latch bolt biasing means cooperating to define a second spring-biased assembly;

(j) securing means for threadedly engaging the mounting studs and for cooperating with the mounting studs to clamp the housing bracket means into engagement with the mounting surface to rigidly connect the first and second spring-biased assemblies such that one end region of the elongate latch bolt extends into overlying relationship with the opening that is formed in the back wall whereby, when the handle is in its nested position and the latch bolt is in its latched position, the rearwardly extending projection of the handle directly engages the one end region of the latch bolt to releasably retain the latch bolt in its latched position in opposition to the action of the latch bolt biasing means, and whereby, when the handle is pivoted to its operated position in opposition to the action of the handle-biasing means, the one end region of the latch bolt is disengaged by the rearwardly extending projection of the handle so as to permit the latch bolt to pivot toward its unlatched position under the influence of the latch bolt biasing means; and, (k) interengageable formation means carried on the rearwardly extending projection of the handle and on the one end of the latch bolt for permitting the handle to move to its nested position under the influence of the handle biasing means only when the latch bolt is in its latched position.

20. The latch of claim 19 wherein the handle means is formed as a one-piece structure from injection molded plastics material.

21. The latch of claim 19 wherein:

(a) the housing bracket means defines a slide channel that extends alongside the opening that is formed through the back wall;

(b) the rearwardly extending handle projection is configured so as to reside twoard one side of the back wall opening when the handle is nested, and to reside toward an opposite side of the back wall opening when the handle is moved to its operated position; and, (c) a locking member is positioned in the slide channel and is movable between locked and unlocked positions, with the locking member being configured such that when it is in its locked position it blocks movement of the rearwardly extending handle projection from the one side to the other side of the back wall opening, whereby the locking member blocks movement of the handle to its operated position when the locking member is in its locked position.

22. The latch of claim 19 additionally including striker means for engaging the latch bolt when the latch bolt is in its latched position, for pivoting the latch bolt from its unlatched position to its latched position as a closure on which the latch is mounted is moved into closed position wherein the latch bolt engages the striker means, and, for effecting pop-opening movement of the closure when the handle is operated to pivot the handle from its nested position to its operated position whereupon the latch bolt is released to move under the influence of the latch bolt biasing means to pivot from its latched position to its unlatched position.

23. The latch of claim 22 wherein:

(a) the striker means defines a bolt receiving chamber for receiving the latch bolt when the latch bolt is in its latched position, and a pair of engagement surfaces on opposite sides of an opening that extends into the bolt-receiving chamber;

(b) one of the engagement surfaces is configured to engage an end region of the latch bolt when the closure is being moved to its closed position, whereby the one striker engagement surface serves to engage the latch bolt to effect pivotal movement of the latch bolt to its latched position as the closure is being moved to its closed position; and, (c) the other of the striker engagement surfaces is configured to overlie the latch bolt when the latch bolt is in its latched position to prevent opening movement of the closure when the latch bolt is in its latched position.

24. The latch of claim 19 wherein the portion of the push-to-operate handle on which an operator is to push in order to move the handle from its nested position toward its operated position carries indicia to designate said handle portion to which force should be applied by the operator.

25. The latch of claim 24 wherein the indicia includes the word "PUSH."

26. The latch of claim 19 additionally including striker means configured to engage the latch bolt when a pivotally mounted closure on which the latch is mounted is moved toward its closed position wherein the latch bolt is brought toward a position of engagement with the striker means;

(a) the striker means including structure defining a latch bolt engagement surface for engaging the latch bolt as the latch bolt approaches the striker means during closing of the door, and for effecting rotation of the latch bolt from its unlatched to its latched position in response to complete movement of the closure to its closed position; and, (b) the striker means having formation means for releasably retaining the latch bolt in its latched position once the latch bolt has been received by the striker means and has moved to its latched position as the closure has completed its movement to its closed position.

27. A latch, comprising:

(a) housing means defining a pan-shaped housing having a front wall with housing portions located rearwardly relative to the front wall and defining a forwardly-facing recess that opens through the front wall, with the front wall having portions that define a mounting flange which extends about the recess, with the housing portions that define the recess including a back wall that extends substantially parallel to the front wall at a location that is behind the front wall, with portions of the back wall defining a rearwardly facing mounting surface, and with all such portions of the housing means being formed integrally to define a one-piece housing as by injection molding the housing from thermoplastics material;

(b) threaded fastener means having portions embedded in and rigidly connected to the material of a back wall, including two mounting studs that each have elongate shank means extending rearwardly from the back wall at spaced locations near opposite sides of the mounting surface, and with each of the elongate shank means having threaded portions formed thereon;

(c) housing bracket means including a mounting plate portion for extending across and engaging the mounting surface of the back wall, with the mounting plate portion having holes formed therethrough to permit the elongate shanks of the mounting studs to extend through the holes, and with the housing bracket means also including two spaced mounting formations that extend rearwardly from the mounting plate portion;

(d) securing means threaded onto the threaded shanks for clamping the mounting plate portion into engagement with the mounting surface;

(e) aligned openings formed through the back wall and through the mounting plate portion;

(f) handle means including a push-to-operate handle and handle mounting means pivotally connecting the handle to the housing for movement relative thereto between a nested position wherein the handle is nested in the recess and extends substantially flush with the front wall, and an operating position wherein at least portions of the handle are pivoted inwardly with respect to the recess and toward the back wall of the housing, with the handle having a rearwardly extending portion that projects through the aligned openings that are formed in the back wall and in the mounting plate portion for moving within a region that is located behind the mounting surface in response to movement of the handle between its nested and operated positions;

(g) handle biasing means interposed between the handle means and the housing means for biasing the handle away from its operated position toward its nested position, with the housing means, the handle means and the handle biasing means cooperating to define a first spring-biased assembly;

(h) latch bolt means including an elongate latch bolt that has a central region that extends between the rearwardly extending mounting formations, and latch bolt mounting means for pivotally connecting the latch bolt to the housing bracket means for movement relative to the housing bracket means between latched and unlatched positions;

(i) latch bolt biasing means interposed between the latch bolt means and the housing bracket means for biasing the latch bolt away from its latched position toward its unlatched position, with the housing bracket means, the latch bolt means and the latch bolt biasing means cooperating to define a second spring-biased assembly, and with the securing means serving to rigidly connect the first and second spring-biased assemblies such that one end region of the elongate latch bolt extends into overlying relationship with the aligned openings that are formed through the back wall and through the mounting plate means whereby, when the handle is in its nested position and the latch bolt is in its latched position, the rearwardly extending projection of the handle directly engages the one end region of the latch bolt to releasably retain the latch bolt in its latched position in opposition to the action of the latch bolt biasing means, and whereby, when the handle is pivoted to its operated position in opposition to the action of the handle-biasing means, the one end region of the latch bolt is disengaged by the rearwardly extending projection of the handle so as to permit the latch bolt to pivot toward its unlatched position under the influence of the latch bolt biasing means; and (j) interengageable formation means carried on the rearwardly extending projection of the handle and on the one end of the latch bolt for permitting the handle to move to its non-operated position under the influence of the handle biasing means only when the latch bolt is in its latched position.

28. The latch of claim 27 wherein a rearwardly extending formation is provided on a back surface of the handle, and the handle biasing means includes a compression coil spring that is interposed between the handle and the housing for biasing the handle toward its nested position, with the spring having opposed end regions, with one of the end regions being reeved around portions of the rearwardly extending formation to connect the handle to the compression coil spring, and with the other of the end regions engaging the back wall of the housing.

29. The latch of claim 27 wherein:

(a) the housing bracket means defines a slide channel that extends alongside the aligned openings;

(b) the rearwardly extending handle projection is configured so as to reside toward one side of the aligned openings when the handle is nested, and to reside toward an opposite side of the aligned openings when the handle is moved to its operated position; and, (c) a locking member is positioned in the slide channel and is movable between locked and unlocked positions, with the locking member being configured such that, when the locking member is in its locked position it blocks movement of the rearwardly extending handle projection from the one side to the other side of the aligned openings, whereby the locking member blocks movement of the handle to its operated position when the locking member is in its locked position.

30. The latch of claim 27 additionally including striker means for engaging the latch bolt when the latch bolt is in its latched position; for pivoting the latch bolt from its unlatched position to its latched position as a closure on which the latch is mounted is moved into closed position wherein the latch bolt engages the striker means; and, for effecting pop-opening movement of the closure when the handle is operated to pivot the handle from its nested position to its operated position, whereupon the latch bolt is released to move under the influence of the latch bolt biasing means to pivot from its latched position to its unlatched position.

31. The latch of claim 30 wherein:

(a) the striker means defines a bolt receiving chamber for receiving the latch bolt when the latch bolt is in its latched position, and a pair of engagement surfaces on opposite sides of an opening that extends into the bolt-receiving chamber;

(b) one of the engagement surfaces is configured to engage an end region of the latch bolt when the closure is being moved to its closed position, whereby the one striker engagement surface serves to engage the latch bolt to effect pivotal movement of the latch bolt to its latched position as the closure is being moved to its closed position; and, (c) the other of the striker engagement surfaces is configured to overlie the latch bolt when the latch bolt is in its latched position to prevent opening movement of the closure when the latch bolt is in its latched position.

32. The latch of claim 27 wherein the portion of the push-to-operate handle on which an operator is to push in order to move the handle from its nested position toward its operated position carries indicia to designate said handle portion to which force should be applied by the operator.

33. The latch of claim 32 wherein the indicia includes the word "PUSH."

34. The latch of claim 27 additionally including striker means configured to engage the latch bolt when a pivotally mounted closure on which the latch is mounted is moved toward its closed position wherein the latch bolt is brought toward a position of engagement with the striker means;

(a) the striker means including structure defining a latch bolt engagement surface for engaging the latch bolt as the latch bolt approaches the striker means during closing of the door, and for effecting rotation of the latch bolt from its unlatched to its latched position in response to complete movement of the closure to its closed position; and, (b) the striker means having formation means for releasably retaining the latch bolt in its latched position once the latch bolt has been received by the striker means and has moved to its latched position as the closure has completed its movement to its closed position.

* * * * *